United States Patent [19]

Sabongi

[11] Patent Number: 4,699,868

[45] Date of Patent: Oct. 13, 1987

[54] PHOTOGRAPHIC TANNING DEVELOPER FORMULATION

[75] Inventor: Gebran J. Sabongi, St. Paul, Minn.

[73] Assignee: Minnesota Mining and Manufacturing Company, St. Paul, Minn.

[21] Appl. No.: 897,542

[22] Filed: Aug. 18, 1986

Related U.S. Application Data

[63] Continuation-in-part of Ser. No. 727,240, Apr. 25, 1985, abandoned, which is a continuation-in-part of Ser. No. 585,412, Mar. 2, 1984, abandoned.

[51] Int. Cl.[4] ..... G03C 1/02

[52] U.S. Cl. ..... 430/264; 430/268; 430/486; 430/331; 430/484; 430/485; 430/204; 430/205; 430/265; 430/267; 430/250; 430/479; 430/438; 430/306; 430/309; 430/405

[58] Field of Search ..... 430/204, 205, 264–268, 430/306, 309, 331, 484, 485, 405, 438, 479, 250, 490, 486

[56] References Cited

U.S. PATENT DOCUMENTS

| | | | |
|---|---|---|---|
| 1,516,161 | 11/1924 | Sulzberger | 430/438 |
| 1,663,959 | 3/1928 | Schestakoff | 430/490 |
| 2,404,774 | 7/1946 | Dersch et al. | 430/399 |
| 2,415,666 | 2/1947 | Weissberger et al. | 430/485 |
| 2,837,430 | 6/1958 | Goldberg et al. | 430/292 |
| 2,967,772 | 1/1961 | Willems et al. | 430/264 |
| 3,287,124 | 11/1966 | Green et al. | 430/250 |
| 3,287,125 | 11/1966 | Green et al. | 430/250 |
| 3,293,035 | 12/1966 | Van Hoof et al. | 430/264 |
| 3,364,024 | 1/1968 | Yackel et al. | 430/202 |
| 3,440,049 | 4/1969 | Moede | 430/264 |
| 3,723,119 | 3/1973 | Yoshida et al. | 430/267 |
| 3,746,544 | 7/1973 | Heilmann | 430/466 |
| 3,772,022 | 11/1973 | Okutsu et al. | 430/266 |
| 3,806,345 | 4/1974 | Willems | 430/250 |
| 3,847,618 | 11/1974 | Hofman et al. | 430/264 |
| 3,984,243 | 10/1976 | Shimamura et al. | 430/267 |
| 4,055,426 | 10/1977 | Ogawa et al. | 430/376 |
| 4,155,763 | 5/1979 | Hasebe et al. | 430/469 |
| 4,170,478 | 10/1979 | Case et al. | 430/357 |
| 4,233,392 | 11/1980 | Friedel | 430/264 |
| 4,233,393 | 11/1980 | Shiba et al. | 430/265 |
| 4,254,210 | 3/1981 | Van Stappen | 430/285 |
| 4,269,929 | 5/1981 | Nothnagle | 430/264 |
| 4,283,479 | 8/1981 | Hamoaka et al. | 430/264 |
| 4,299,909 | 11/1981 | Imatomi et al. | 430/264 |

FOREIGN PATENT DOCUMENTS

| | | |
|---|---|---|
| 560371 | 3/1944 | United Kingdom . |
| 2026186 | 1/1980 | United Kingdom . |
| 2060921 | 5/1981 | United Kingdom . |
| 2072174 | 9/1981 | United Kingdom . |
| 2075496 | 11/1981 | United Kingdom . |

OTHER PUBLICATIONS

C. I. K. Mees and T. H. James, *The Theory of the Photographic Process,* 3rd ed., McMillan Co., 1966, p. 304.

Beilstein Organische Chemie, 4th ed., vol. 2, pp. 90, 187; vol. 3, p. 95; vol. 4, pp. 70, 128; vol. 9, p. 31; vol. 10, p. 98; vol. 12, p. 376.

*Primary Examiner*—Won H. Louie

*Attorney, Agent, or Firm*—Donald M. Sell; James A. Smith; Gerald F. Chernivec

[57] ABSTRACT

An alkaline aqueous tanning developing solution for photographic image development comprising at least one hydroxylamine derivative. Preferred formulations may also contain at least one water-miscible polyhydroxy aliphatic organic solvent and/or a developing agent which comprises a polyhydroxybenzene compound having at least two hydroxy groups and at least one electron withdrawing and good leaving group suitable for nucleophilic addition.

10 Claims, No Drawings

PHOTOGRAPHIC TANNING DEVELOPER FORMULATION

This is a continuation-in-part of application Ser. No. 727,240, filed Apr. 25, 1985, now abandoned which is a continuation-in-part of application Ser. No. 585,412 filed Mar. 2, 1984, now abandoned.

FIELD OF THE INVENTION

This invention relates to photographic processing wherein a tanning developer solution is utilized to prepare hardened imagewise exposed silver halide gelatin emulsion layers.

BACKGROUND ART

It is well known in the art to utilize developing agents to insolubilize colloidal materials, such as gelatin, in a silver halide emulsion. Typically, in the employment of this hardening reaction, a tanning developing agent is utilized to develop an exposed silver halide colloidal emulsion and crosslink the molecules of the emulsion, i.e., harden the emulsion, after which the unexposed areas may be washed away utilizing warm water, to thereby provide a photographic image or resist of the hardened or tanned colloidal material.

During processing, the oxidation products of the developing agents which are formed in the exposed regions of the image diffuse through the gelatin layers containing same, hardening the colloidal gelatin itself. Accurate, i.e., imagewise, tanning development requires that the oxidation products of the developing agents which are produced by the reduction of the silver image and harden the gelatin remain in close proximity to the reduced silver image. The desired low mobility of these oxidation products necessitates their low solubility in the developer solution, a function of their minimal interaction with the components of that solution.

Such photographic emulsion layers typically may contain colorants, e.g., pigments, carbon black, etc., which may impart color to the thus formed images. Literature examples of such photographic elements include those described in U.S. Pat. Nos. 3,364,024; 2,837,430; 4,283,479; 4,299,909; 4,233,392; 4,233,393; 4,254,210; and G.B. Pat. No. 2,026,186A.

Tanning developer solutions typically used for such photographic elements are simple aqueous solutions which contain therein a high content of sulfate salts, wherein the tanning developing agents themselves may be incorporated within the gelatin layers of the silver halide emulsion-containing article.

In conventional photographic silver halide systems, antioxidants such as sulfites are commonly utilized during development. Conventional photographic developers reduce a latent silver image to a black silver image. The oxidation products of the developing agents must be sufficiently soluble in the developing solution that they will be completely washed out of the gelatin matrix. Incomplete removal of the oxidation products may result in undesirable background staining and coloring. Therefore conventional photographic developer solutions typically contain substantial amounts of sulfite salts to enhance the solubility of the oxidation products. Furthermore, sulfites also act as preservatives and antioxidants which retard the aerial oxidation of the developing agents.

In a tanning developer system, the developer solution is, however, typically devoid of common antioxidants such as sulfite salts, or contains a reduced level thereof, due to their harmful effect on the tanning process, as is described in C. E. K. Mees and T. H. James, *The Theory Of The Photographic Process*, 3rd Edition, the McMillan Co., 1966, at page 304. Even small quantities, i.e., two to three grams per liter, of an antioxidant such as sodium sulfite may limit or destroy the tanning action. (G. M. Haist, *Modern Photographic Processing*, Wiley and Sons, 1979 at page 512.)

As a result, the image processing step of tanning development is susceptible to air oxidation, which can display itself through the non-imagewise hardening of the gelatin layers when the photographic element is exposed to air while wet with the developing solution.

To attempt to combat this problem, the literature has reported the use of materials such as ascorbic acid as an antioxidant, as described in GB Pat. No. 560,371 and U.S. Pat. No. 2,415,666, and ascorbic acid borates as described in U.S. Pat. No. 2,967,772.

Conversely, U.S. Pat. No. 3,293,035 discloses the use of primary amines and monohydroxy aromatic compounds, themselves not being developing agents, to improve selective tanning only in image areas, while U.S. Pat. No. 2,404,774 details the use of urea as a softening agent for gelatin coatings. Nitrile compounds are further cited as stabilizing agents for graphic arts developing solutions; e.g., U.S. Pat. No. 3,772,022.

Hydroxylamine derivatives have been taught to supplement the stability of color developer solutions, as for example in U.S. Pat. Nos. 3,746,544; 4,155,763; 4,055,426; and 4,170,478. Alkanolamines and their derivatives are taught to be well known as pH regulators in the area of graphic arts developer solutions, see for example, U.S. Pat. No. 3,984,243. Furthermore, in the area of dye-forming developers, the use of hydroxylamines together with alkanolamines has been taught to enhance the stability of such developing solutions, see for example GB Pat. Nos. 2,060,921B and 2,075,496B and EPO Pat. No. 47781.

Present developer solutions, however, do not provide adequate protection from the oxidation effects of air as displayed by non-imagewise hardening.

Also, known developer solutions have a narrow temperature latitude in which they function, i.e., either only at high temperatures or low temperatures. Low temperature developers are generally slow, requiring extended residence time in the developing solution, thereby increasing susceptibility to oxidation from the air. High temperature developers accelerate image development and the effects of oxidation.

The oxidation manifests itself as non-imagewise hardening, which affects final image quality, e.g., half-dot retention is very narrow because the 90 percent dots are clogged and the 5 percent dots too large.

SUMMARY OF THE INVENTION

I have now discovered a tanning developer solution capable of eliminating the above-mentioned problems of air oxidation which unexpectedly allows image processing at a wider latitude of temperatures, especially at room as well as at elevated temperatures, a concept not heretofore available.

In accordance with my invention, the tanning developer solution thereof comprises an aqueous alkaline solution containing hydroxylamine derivatives, preferably together with water-miscible polyhydroxy aliphatic organic solvents, which allows for the elimination of non-imagewise tanning of the gelatin.

If desired, the developing solution may also contain one or more silver image developing agents, preferably a polyhydroxy benzene derivative with at least two hydroxy groups together with one or more electron withdrawing and good leaving groups for nucleophilic addition.

Such compounds are usually poor silver image developing agents and are active gelatin cross linkers, but in superadditivity with more active silver image developing agents, as hereafter discussed, the combination thereof allows a more facile imagewise development and tanning at a significantly wider temperature range without attendant background non-imagewise tanning.

DETAILED DESCRIPTION

The aqueous tanning developer solution of my invention can be typically rendered alkaline to a pH range of from about 8 to about 12 utilizing conventional alkaline metal salts, e.g., carbonates, bicarbonates, hydroxides, etc., or by using organic bases, e.g., amines, alkanolamines, etc., and contains derivatives of hydroxylamines as stabilizers against non-imagewise gelatin hardening.

Hydroxylamine derivatives suitable for the invention have the following general structure:

$$R_1(R_2)N—O—R_3$$

wherein $R_1$ and $R_2$, which may be the same or different, are each a hydrogen atom, a substituted or unsubstituted alkyl group, a substituted or unsubstituted aralkyl group, a substituted or unsubstituted aryl group, a substituted or unsubstituted carbonyl, a substituted or unsubstituted amino carbonyl, or a heterocyclic group, or are in combination and derive a heterocyclic ring structure. $R_3$ is a hydrogen atom, a substituted or unsubstituted alkyl group, a substituted or unsubstituted aralkyl group, a substituted or unsubstituted aryl group, or a heterocyclic group. Typical substituents may be electron donating or electron withdrawing groups. Examples thereof include halogens, alkyls, alkoxyls, nitros, sulfos, hydroxyls, carboxyls, phenyls, etc.

The following table lists illustrative representatives of useful derivatives of hydroxylamine, wherein $R_1$, $R_2$, and $R_3$ represent the substituent groups in Formula 1.

TABLE 1

| Derivatives of Hydroxylamine | | | |
|---|---|---|---|
| Compound No. | $R_1$ | $R_2$ | $R_3$ |
| 1 | H | H | H |
| 2 | $CH_3$ | $CH_3$ | H |
| 3 | $CH_3$ | H | $CH_3$ |
| 4 | $PhCH_2$ | $PhCH_2$ | H |
| 5 | H | $NH_2CO$ | H |
| 6 | $CH_3CO$ | H | H |
| 7 | HCO | H | H |
| 8 | PhCO | H | H |

In preferred hydroxylamine derivatives, $R_2$ is a substituted or unsubstituted carbonyl, i.e., $R_2$ is $R_4CO$- wherein $R_4$ is a hydrogen atom, a substituted or unsubstituted alkyl group, a substituted or unsubstituted aralkyl group, a substituted or unsubstituted aryl group, a substituted or unsubstituted amino group, or a heterocyclic ring. Hydroxylamine derivatives wherein $R_1$ and $R_3$ are hydrogen atoms and $R_2$ is $R_4CO$- wherein $R_4$ is an amino group or derivative thereof are most preferred. Compound 5 in Table I is an example of such a hydroxylamine derivative. Such compounds are preferred because they are stable in alkaline solutions, are easy to prepare, and dissolve easily in developer solutions.

Other hydroxylamine derivatives which are useful herein are described in U.S. Pat. Nos. 3,287,125; 3,287,124; 4,055,426; and *Beilstein Organische Chemie*, 4th ed., Vol. 2, page 90; Vol. 2, page 187; Vol. 9, page 31; Vol. 10, page 98; Vol. 3, page 95; Vol. 4, page 70; Vol. 12, page 376; and Vol. 4, page 218.

Examples of other suitable hydroxylamine derivatives include N-alpha-sulfopropylhyroxylamine, N-alpha-carboxypropylhydroxylamine; alpha-hydroxylamine-beta-phenylpropionic acid, N-m-sulphophenylhydroxylamine.

The hydroxylamine derivatives should be contained in concentrations of between 0.001 to about 10.0 grams per liter of developing solution, and preferably in amounts between about 0.01 to about 5.0 grams per liter.

At increasing concentrations, the image may become increasingly inhibited from satisfactory development, while decreasing concentrations reduce the desired effect on oxidation from the air.

The developing solution of my invention preferably also contains at least one water-miscible polyhydroxy solvent which is stable in the sense that it is not reactive with other components in the solution. Such solvents facilitate the dissolvement of some hydroxylamine derivatives which are otherwise slow to dissolve, cause the developer solution to spread uniformly over the surface of the photographic element, and contribute to complete washing away of the gelatin in background areas. Such solvents should not be excessively volatile at temperatures at which the developing solutions are used during processing. Useful amounts are from between about 5 to about 700 milliliters per liter of solution, and preferably between from about 100 to about 300 milliliters per liter. Increasing concentrations may tend to precipitate inorganic salts in the developer or make their dissolution difficult. Developer solutions containing reduced concentrations of such solvents, while useful, will not achieve the full benefits described above. Suitable solvents include alkanols, e.g., isopropanol, and polyhydroxy organic solvents, e.g., ethylene glycol, triethylene glycol, etc.

In addition, the developing solution may also contain silver image developing agents, and if so, preferably these are polyhydroxybenzene derivatives having at least two hydroxy groups and at least one electron withdrawing and good leaving group for nucleophilic addition. Such groups are well known in organic chemistry, and include, for example, halides, cyano, nitro, carboxyl esters, alkoxyls, carboxyl, esters, e.g., acetates, tosylates, or benzoates. Polyhydroxybenzene derivatives which contain halide or cyano groups tend to dissolve better and are most preferred.

Examples of these polyhydroxybenzene derivatives include the following:

1. 2,3-dichloro-5,6-dicyano-1,4-hydroquinone
2. 2,3,5,6-tetrachloro-1,4-hydroquinone
3. 3,4,5,6-tetrabromo-1,2-hydroquinone
4. 2,3,5,6-tetracyano-1,4-hydroquinone
5. 2,5-dichloro-3,6-dihydroxy-1,4-hydroquinone
6. 2,3-dichloro-1,4-dihydroxynaphthalene
7. 2-chloro-1,4-hydroquinone These electron poor developing agents, e.g., the polyhydroxybenzene derivatives, may be present in amounts between from about 0.5 to about 15 grams per liter, and more preferably between from about 1 to about 5 grams per liter.

It is well known that increasing numbers of electronegative or electronwithdrawing groups on a developing agent inhibit the reduction of the latent silver image, a critical prerequisite to the gelatin crosslinking of tanning development. (Haist, *Modern Photographic Processing* at page 518.) Such compounds are typically poor silver image developing agents and active gelatin crosslinkers, but in superadditivity with more active silver image developing agents, the combination thereof provides a more facile imagewise development and tanning at a wider temperature latitude without attendant background non-imagewise tanning from air oxidation.

These more active silver image developing agents include any of those known in the literature, for example, hydroquinone, catechol, pyrogallol and their derivatives having electron rich substituents.

Superadditivity effects can be still further enhanced by including a third developing agent such as phenidone, aminophenol, metol, amidol or their derivatives.

The developing agents may all be incorporated within the photographic element, within the developing solution, or a part in each. Preferably, the more active silver image developing agents are incorporated within the light-sensitive photographic element while the agents containing electron withdrawing groups are contained within the developing solution. This optimizes air oxidation protection, since the more active developers are adversely affected by air to a greater extent.

When utilized in the presence of other more active silver imaging developing agents, the preferred ratios, by weight, are between about 20:1 and 1:1, and preferably are about 2:1, electron poor to electron rich, respectively.

When a third developing agent is utilized, the preferred weight ratios are 10:1:0.1, and most preferred 2:1:0.5, electron poor to electron rich developing agents.

Furthermore, the developer solution may also contain other components known to be useful as photographic developers, as described in L. F. A. Mason, *Photographic Processing Chemistry*, Focal Press, London, 1966. Examples therein include inorganic salts to reduce the gelatin swelling, sulfates, phosphates, borates, surfactants; development accelerators such as polyoxyalkylene derivatives, as described in U.S. Pat. No. 1,269,312; and gelatin softening agents such as urea, as described in U.S. Pat. No. 2,404,774.

The invention will now be more specifically described by the following non-limiting examples, wherein all parts are by weight unless otherwise specified.

A tanning silver halide photographic element was first prepared for use in testing the developers of my invention by applying on a conventionally subbed polyester base the following light-sensitive layers:

(a) A light-sensitive unhardened gelatin layer containing a silver iodo-bromide emulsion (containing 94 mole percent silver bromide) with a grain size between 0.34 and 1.6 microns. Also contained therein was a pigment dispersion consisting of 4 percent by weight gelatin, 11 percent by weight Colanyl Red FGR, 9 percent by weight Colanyl Yellow FGL, and 9 percent by weight Flexonyl Blue AN, as a water pigment dispersion available from American Hoechst.

The emulsion was chemically and optically sensitized, and then coated at the coverage rate of 0.5 grams per square meter with a silver to gelatin ratio of 0.3 and hydroquinone and phenidone thus obtaining a gelatin/hydroquinone/phenidone ratio of 1:0.07:0.01.

(b) Over this layer was applied an unhardened gelatin protective layer containing gelatin at a coverage of 1 gram per square meter and 2,5-diisooctyl hydroquinone in a dispersion with tricresylphosphate at a coverage of 0.96 grams per square meter.

A reference photographic element was exposed to a sensitometric wedge (0.3 logE) for $2\times10^{-6}$ seconds with a 1.29 neutral density filter, and to alphabetic letters by contact exposure in a vacuum frame of a photographic enlarger. The reference element was then manually developed for 30 seconds at 90° F., unless otherwise indicated, in the developer solution, and dip washed with warm water for 30 seconds at 90° F.

Each test photographic element was then exposed and developed in a similar manner to a reference sample including an additional step, that being the exposure thereof to air for 30 seconds while wet with developer solution and prior to the dip wash step. The images were then wiped clean with a wet soft tissue to remove residual pigmentation. The minimum and maximum densities of the wedge image were measured and the background non-imagewise hardening was monitored and noted relative to various developer solutions.

In each of the following test solutions, the final pH thereof was adjusted to 10.1 with sodium bicarbonate. In each of the following examples, the components were added to the distilled water and mixed to provide a developer solution. The enumerated hydroxylamines refer to the hydroxylamine derivatives tabulated above in Table 1.

EXAMPLES 1-4

Developer formulations were prepared to illustrate the effect of hydroxylamine derivatives therein. The test results are as follows:

| Developer | Ref. | Test Developers | | |
|---|---|---|---|---|
| Component | No. 1 | 2 | 3 | 4 |
| Distilled water (ml) | 1000 | 1000 | 1000 | 1000 |
| Sodium carbonate (g) | 20 | 20 | 20 | 20 |
| Sodium sulfate (g) | 120 | 120 | 120 | 120 |
| Hydroxylamine No. 1 (g) | — | 0.1 | — | — |
| Hydroxylamine No. 2 (g) | — | — | 1.0 | — |
| Hydroxylamine No. 3 (g) | — | — | — | 1.0 |
| Reference photo-element (no air exposure): | | | | |
| Dmin | 0.01 | 0.01 | 0.02 | 0.01 |
| Dmax | 1.25 | 1.25 | 1.20 | 1.20 |
| Non-imagewise hardening | None | None | None | None |
| Test photo-element (with exposure to air): | | | | |
| Dmin | 0.40 | 0.01 | 0.02 | 0.01 |
| Dmax | 1.25 | 1.25 | 1.20 | 1.20 |
| Non-imagewise hardening | Yes | No | No | No |

EXAMPLES 5-6

Developer formulations were prepared to illustrate the effect of polyhydroxy solvents contained therein. The test results are as follows:

| Developer Component | Ref. No. 1 | Test Developers 5 | 6 |
|---|---|---|---|
| Distilled water (ml) | 1000 | 1000 | 1000 |
| Sodium carbonate (g) | 20 | 20 | 20 |
| Sodium sulfate (g) | 120 | 120 | 120 |
| Ethylene glycol (ml) | — | 100 | — |
| Triethylene glycol (ml) | — | — | 100 |
| Test photo-element (with exposure to air): | | | |
| Non-imagewise hardening | Yes | Partial | Partial |

EXAMPLES 7-10

Developer formulations were prepared to illustrate the joint effect of hydroxylamine derivatives and polyhydroxy solvents contained therein. The test results are as follows:

| Developer Component | Ref. No. 1 | Test Developers 7 | 8 | 9 | 10 |
|---|---|---|---|---|---|
| Distilled water (ml) | 1000 | 1000 | 1000 | 1000 | 1000 |
| Sodium carbonate (g) | 20 | 20 | 20 | 20 | 20 |
| Sodium sulfate (g) | 120 | 120 | 120 | 120 | 120 |
| Hydroxylamine No. 2 (g) | — | 0.5 | — | — | — |
| Hydroxylamine No. 3 (g) | — | — | 1.5 | — | — |
| Hydroxylamine No. 5 (g) | — | — | — | 1.0 | — |
| Hydroxylamine No. 8 (g) | — | — | — | — | 1.0 |
| Ethylene glycol (ml) | — | 100 | 100 | 100 | 100 |
| Test photo-element (with exposure to air): | | | | | |
| Non-imagewise hardening | Yes | No | No | No | No |

EXAMPLES 11-14

Developer formulations were prepared utilizing hydroxylamine derivatives together with other components. The test results are as follows:

| Developer Component | Ref. No. 1 | Test Developers 11 | 12 | 13 | 14 |
|---|---|---|---|---|---|
| Distilled water (ml) | 1000 | 800 | 800 | 800 | 800 |
| Sodium carbonate (g) | 20 | 20 | 20 | 20 | 20 |
| Sodium sulfate (g) | 120 | 120 | 180 | 240 | 120 |
| Hydroxylamine No. 2 (g) | — | 2.0 | 2.0 | 2.0 | 2.0 |
| EDTA* (g) | — | — | — | — | 2.0 |

-continued

| Developer Component | Ref. No. 1 | Test Developers 11 | 12 | 13 | 14 |
|---|---|---|---|---|---|
| Ethylene glycol (ml) | — | 200 | 200 | 200 | 200 |
| Test photo-element (with exposure to air): | | | | | |
| Non-imagewise hardening | Yes | None | None | Partial | None |

*Ethylenediaminetetraacetic Acid

EXAMPLES 15-17

Developer formulations were prepared utilizing hydroxylamine derivatives in conjunction with other photographic developing agents. Development was for five minutes at 68° F. The test results are as follows:

| Developer Component | Ref. No. 15 | Test Developers 16 | 17 |
|---|---|---|---|
| Distilled water (ml) | 1000 | 800 | 700 |
| Sodium carbonate (g) | 20 | 20 | 20 |
| Sodium sulfate (g) | 120 | 120 | 120 |
| Hydroxylamine No. 5 (g) | — | 0.5 | 0.5 |
| Tetrachloro-1,4-hydroquinone (g) | 3.0 | 3.0 | 3.0 |
| Phenidone (g) | — | — | 0.5 |
| Ethylene glycol (ml) | — | 200 | 300 |
| Test photographic element (with exposure to air): | | | |
| Non-imagewise hardening | Yes | No | No |

EXAMPLES 18-27

Developer solutions were prepared for testing with the photographic tanning element noted above which illustrates the suitability of my invention for processing over a wide temperature range. The general formula for the developer solution is as follows:

| General Formula | Amount |
|---|---|
| Distilled water | (1000-Z) ml |
| Sodium carbonate | 20 g |
| Sodium sulfate | 120 g |
| Hydroxylamine No. 5 | x g |
| Developing agent | y g |
| Ethylene glycol | z ml |

The test photographic element was exposed to air as discussed above and processed at two separate temperatures. Imagewise and non-imagewise tanning was then observed. The results are as follows:

Results of Examples 18-27

| Test Developer | Hydroxylamine (g) | Glycol (ml) | Developing Agent* (g) | 300 seconds (68° F.) Imagewise | 300 seconds (68° F.) Non-Imagewise | 30 seconds (95° F.) Imagewise | 30 seconds (95° F.) Non-Imagewise |
|---|---|---|---|---|---|---|---|
| 18 | 0.0 | 0.0 | 0.0 | None | Yes | Yes | Yes |
| 19 | 0.0 | 0.0 | A (2) | Yes | Yes | Yes | Yes |
| 20 | 0.0 | 0.0 | C (2) | Yes | Partial | Yes | Partial |
| 21 | 0.0 | 0.0 | D (2) | Yes | Partial | Yes | Partial |
| 22 | 0.0 | 0.0 | B (2) | Yes | Partial | Yes | Partial |
| 23 | 0.5 | 200 | B (3) | Yes | None | Yes | None |
| 24 | 0.5 | 200 | C (3) | Yes | None | Yes | None |
| 25 | 0.5 | 200 | D (3) | Yes | None | Yes | None |
| 26 | 0.5 | 0.0 | B (3) | Yes | Partial | Yes | Partial |

-continued

| Test Developer | Hydroxyl-amine (g) | Glycol (ml) | Developing Agent* (g) | Results of Examples 18-27 300 seconds (68° F.) Imagewise | Non-Imagewise | 30 seconds (95° F.) Imagewise | Non-Imagewise |
|---|---|---|---|---|---|---|---|
| 27 | 0.0 | 200 | B (3) | Yes | Partial | Yes | Partial |

*A — Hydroquinone
B — 2,3,5,6-tetrachloro-1,4-hydroquinone
C — 3,4,5,6-tetrabromo-1,2-hydroquinone
D — 2-chloro-1,4-hydroquinone

EXAMPLES 28-30

Developer formulations were prepared utilizing hydroxylamine derivatives for comparison of the elimination of oxygen induced non-imagewise tanning and shelf life. The test results are as follows:

| Developer Component | Test Developers 28 | 29 | 30 |
|---|---|---|---|
| Distilled Water (ml) | 800 | 800 | 800 |
| Sodium Carbonate (g) | 20 | 20 | 20 |
| Sodium Sulfate (g) | 120 | 120 | 120 |
| Hydroxylamine No. 2 (g) | 1.0 | — | — |
| Hydroxylamine No. 3 (g) | — | 1.0 | — |
| Hydroxylamine No. 5 (g) | — | — | 1.0 |
| Ethylene Glycol (ml) | 200 | 200 | 200 |
| Test photographic element (with air exposure) | | | |
| Non-Imagewise Hardening: | None | None | None |
| Wet image hardness to abrasion: | Low | Good | Good |
| Developer odor after four weeks in container: | Amine Odor | Amine Odor | None |
| Wet image hardness to abrasion of four week old developer solution: | Low | Low | Good |

What is claimed is:

1. A tanning developer solution suitable for forming tanned images in an exposed silver halide gelatin emulsion layer in an imagewise fashion wherein said developer solution is an aqueous alkaline solution substantially free of sulfite and comprising;

at least one soluble hydroxylamine derivative which is capable of reducing or eliminating air-induced non-imagewise hardening of said gelatin, said hydroxylamine derivative having the general formula:

$$R_1(R_2)NOR_3,$$

wherein $R_1$ and $R_3$, which may be the same or different, are a hydrogen atom, a substituted or unsubstituted alkyl group, a substituted or unsubstituted aralkyl group, a substituted or unsubstituted aryl group, or a heterocyclic group; and $R_2$ is $R_4CO$-, wherein $R_4$ is a hydrogen atom, a substituted or unsubstituted alkyl group, a substituted or unsubstituted aralkyl group, a substituted or unsubstituted aryl group, a substituted or unsubstituted amino group, or a heterocyclic group.

2. A tanning developer solution as defined in claim 1 wherein $R_1$ and $R_3$ are hydrogen atoms and $R_4$ is a substituted or unsubstituted amino group.

3. A tanning developer solution as defined in claim 1 further comprising at least one polyhydroxy water-miscible solvent.

4. A tanning developer solution suitable for forming tanned images in an exposed silver halide gelatin emulsion layer in an imagewise fashion wherein said developer solution is an aqueous alkaline solution substantially free of sulfite and comprising;

at least one soluble hydroxylamine derivative which is capable of reducing or eliminating air-induced non-imagewise hardening of said gelatin; and a developing agent which comprises a polyhydroxybenzene derivative having at least two hydroxy groups and at least one electron withdrawing and good leaving group suitable for nucleophilic addition.

5. A tanning developer solution as defined in claim 4 wherein said electron withdrawing and good leaving group is a halide, cyano, nitro, carboxyl, carboxyl ester, ester, or alkoxyl.

6. A tanning developer solution as defined in claim 4 wherein said developing agent is tetrahalohydroquinone.

7. A tanning developer solution as defined in claim 6 wherein said developing agent is tetrachloro-1,4-hydroquinone.

8. A tanning developer solution as defined in claim 4 wherein said hydroxylamine derivative has the general formula:

$$R_1(R_2)\ NOR_3,$$

wherein $R_1$ and $R_2$, which may be the same or different, are a hydrogen atom, a substituted or unsubstituted alkyl group, a substituted or unsubstituted aralkyl group, substituted or unsubstituted aryl group, or a heterocyclic group, or are in combination and derive a heterocyclic ring structure; and $R_3$ is a hydrogen atom, a substituted or unsubstituted alkyl group, a substituted or unsubstituted aralkyl group, substituted or unsubstituted aryl group, or a heterocyclic group.

9. A tanning developer solution as defined in claim 4 wherein said hydroxylamine derivative has the general formula:

$$R_1(R_2)NOR_3,$$

wherein $R_1$ and $R_3$, which may be the same or different, are a hydrogen, a substituted or unsubstituted alkyl group, a substituted or unsubstituted aralkyl group, a substituted or unsubstituted aryl group, or a heterocyclic group; and $R_2$ is $R_4CO$-, wherein $R_4$ is a hydrogen, a substituted or unsubstituted alkyl group, a substituted or unsubstituted aralkyl group, a substituted or unsubstituted aryl group, a substituted or unsubstituted amino group, or a heterocyclic group.

10. A tanning developer solution as defined in claim 4 further comprising at least one polyhydroxy water-miscible solvent.

* * * * *